US005521576A

United States Patent [19]

Collins

[11] Patent Number: 5,521,576

[45] Date of Patent: May 28, 1996

[54] FINE-LINE THICK FILM RESISTORS AND RESISTOR NETWORKS AND METHOD OF MAKING SAME

[76] Inventor: Franklyn M. Collins, 463 Morgan Dr., Lewiston, N.Y. 14092

[21] Appl. No.: 132,480

[22] Filed: Oct. 6, 1993

[51] Int. Cl.[6] ..... H01C 1/012

[52] U.S. Cl. ..... 338/307; 338/308; 338/309; 338/314; 29/620; 427/124; 427/125

[58] Field of Search ..... 338/22 R, 25, 338/28, 226, 307, 308, 314; 29/610, 612; 252/518, 519, 520; 427/124, 125, 101, 103, 118; 346/140 R

[56] References Cited

U.S. PATENT DOCUMENTS

| | | | |
|---|---|---|---|
| 3,928,837 | 12/1975 | Esper et al. | 338/22 R |
| 4,028,657 | 6/1977 | Reichelt | 338/307 |
| 4,050,052 | 9/1977 | Reichelt et al. | 338/308 |
| 4,103,275 | 7/1978 | Diehl et al. | 338/25 |
| 4,146,957 | 4/1979 | Toenshoff | 29/612 |
| 4,282,507 | 8/1981 | Tindall et al. | 338/25 |
| 4,302,737 | 11/1981 | Kausche et al. | 333/172 |
| 4,386,460 | 6/1983 | Klockow | 29/593 |
| 4,485,387 | 11/1984 | Drumheller | 346/140 |
| 4,782,320 | 11/1988 | Shier | 338/295 |
| 5,116,642 | 5/1992 | Sekiguchi | 427/96 |
| 5,206,623 | 4/1993 | Rochette et al. | 338/203 |
| 5,367,283 | 11/1994 | Lauf et al. | 338/34 |
| 5,451,920 | 9/1995 | Hoffheims | 338/34 |

*Primary Examiner*—Tu Hoang
*Attorney, Agent, or Firm*—M. Lukacher

[57] ABSTRACT

Electrical resistors and resistor networks are provided on an insulative substrate with designated conductive terminations by direct and continuous writing of resistive lines in fine-line patterns between and over each two of neighboring terminations from heterogeneous resistive thick film compositions. The resistive lines of line width w and total length l between conductive terminations can be directly written by suitable writing apparatus to have a high aspect ratio n=l/w, thereby providing resistors and resistor networks of high resistance values on an overall substrate area significantly smaller than required for conventional thick film resistors of comparable resistance value and comparable operational characteristics.

19 Claims, 6 Drawing Sheets

FINE-LINE THICK FILM RESISTORS AND RESISTOR NETWORKS AND METHOD OF MAKING SAME

FIELD OF THE INVENTION

The present invention relates to electrical resistors and resistor networks deposed on a common insulated substrate and formed by a pattern of fine lines with high aspect ratio of commercially available thick film compositions. The invention is especially suitable for providing high resistance value resistors and more particularly for providing high resistance value voltage divider networks.

BACKGROUND OF THE INVENTION

In two-dimensional resistive film systems on an insulative substrate, it is common practice to regard the film thickness as relatively invariant and to express the sheet resistivity of the film in terms of ohms per unit area, in conjunction with a geometric factor as the number of unit areas (squares) in series. Higher resistance values can be achieved in such film systems by either using a material or composition of higher sheet resistivity or by increasing the number of serial squares, or both. In well-known thin film resistor systems of the foil type or the vapor-deposited type the resistance value is changed by changing the geometry, i.e., by adjusting the number of squares. In thick film resistors the sheet resistivity is adjusted over a range of several decades by changing the composition of the starting material used for depositing the resistive film. Each of these approaches presents difficulties when attempting to fabricate film resistors or film resistor networks of high resistance value. In thin film resistor technology, the number of squares in series can be increased by decreasing the size or area of the resistive squares or, alternatively, the area of the substrate can be increased if a desired high resistance value is to be achieved. However, both of these approaches have practical limits. In thick film resistor technology, a high resistance value is, in principle, achievable by increasing the resistivity of the thick film material, generally a composite material of conductive particles in an insulative matrix. Thus, in principle, high resistance value thick film resistors or networks can be prepared by reducing the concentration of the conductive particles in the insulative matrix of the thick film composition. In practice, however, it has been found that thick film resistors prepared from very high sheet resistivity compositions show degraded performance or degraded operating characteristics, particularly regarding long-term stability, voltage coefficient of resistance, and current noise index.

Thus, it would be desirable to fabricate high resistance value film resistors and film resistor networks which have stable and reproducible operating characteristics.

SUMMARY OF THE INVENTION

It is the principal object of the invention to provide thick film resistors and thick film resistor networks having improved operating characteristics.

Another object of the present invention is to provide fine-line pattern thick film resistors and resistor networks on an insulative substrate from commercially available thick film compositions which are deposited using a direct-write dispensing system.

A further object of the invention is to provide fine-line pattern thick film resistors and resistor networks having stable operating characteristics at relatively high resistance values.

A still further object of the present invention is to provide fine-line thick film resistors and resistor networks by selection of both the fineness of the resistor line pattern and the sheet resistivity of the thick film composition to achieve optimum stability of operating characteristics of such resistors and resistor networks at a desired value of resistance.

Still another object of the invention is to provide resistive line patterns of high aspect ratio of the resistive lines in thick film resistors and resistor networks suitable for high voltage applications.

Briefly described, in one aspect of the invention, there is provided a fine-line pattern thick film resistor or a fine-line pattern thick film resistor network on a planar insulative substrate having suitably deposed conductive terminals associated with each thick film resistor or with the thick film resistor network. While the term "fine-line pattern" provides only a relative measure of the fineness or width of a resistive line, the transition from a wide line to a fine line is generally regarded as that line width or fineness of the line where the influence of so-called line-edge effects on the resistance of a line becomes measurable, i.e., the line width below which the resistance value of a line becomes measurably larger than the resistance value calculated or predicted from the sheet resistivity of the resistive composition and from the nominal length and nominal width of the resistive line. This edge effect is associated with a gradually, rather than abruptly, decreasing thickness of the resistive line over a band extending outwardly from the center of the line toward each line edge (truly zero thickness). This edge effect can be observed in resistive lines prepared by traditional screen-printing and in lines prepared by a direct-write system. For directly written resistive lines the edge effect has been observed at a nominal line width or fineness narrower than about 10 mils. Accordingly, a resistive line of nominal width equal to, or narrower than, about 10 mils is considered a fine line, or is part of a fine-line pattern.

A commercially available thick film composition having a selected sheet resistivity value is deposited in a fine-line pattern, preferably a serpentine fine-line pattern, between and over each termination on the substrate by continuous writing of a resistive line, utilizing a high-speed dispensing system in which the thick film composition is ejected under pressure through an orifice onto the substrate. A writing system for writing fine lines of thick film compositions has been described in U.S. Pat. No. 4,485,387, issued Nov. 27, 1984, titled *Inking System for Producing Circuit Patterns*. As will become apparent from the detailed description of the invention, the ability to deposit thick films in fine resistive lines affords the opportunity to select a line-to-line pitch over a wide range of line pitch, thereby providing resistance values over a wide range of values using one and the same thick film composition and one and the same line width. By decreasing the line-to-line pitch (increasing the line frequency), very high resistance values can be produced from a given thick film composition, whereby the composition can be selected with a lower sheet resistivity than heretofore possible. Lower sheet resistivity compositions generally provide resistors or resistor networks of greater stability of their operating characteristics, particularly the voltage, coefficient of resistance (VCR) and the current noise index. Thus, the so-called aspect ratio of the printed thick film resistive lines (the aspect ratio is the ratio between the total length of the resistive line divided by the nominal width of the line) affords a geometrical design factor for thick film resistors and resistor networks which provides an improvement over what has been obtainable by conventional thick film resistor fabrication methods. Additionally, using fine-line patterns of high frequency thick film lines between terminations on an insulative substrate of a given area provides for high resistance value resistors using thick film compositions of lower nominal sheet resistivity, thereby providing thick film resistors and networks having more stable operating characteristics than obtainable by prior art devices and methods. Upon depositing the fine-line thick film pattern on the substrate, the substrate is fired conventionally at elevated temperature, and an overglaze can be printed on the resistor pattern and subsequently fired as is known in the art. Following functional testing of finished thick film resistors or networks on the substrate, individual resistors or networks are singulated by cutting the substrate into suitably sized chips. Each chip then receives either a so-called wrap-around external termination or a so-called leaded external termination or other suitable means of connecting each termination on the chip to a chip-external termination.

In accordance with another aspect of the invention, there is provided a fine-line thick film resistor pattern on an insulative cylindrical substrate, whereby the resistive line pattern is chosen so as to provide minimum inductance of high resistance value resistors, making such resistors suitable for high voltage and for high frequency signal applications.

BRIEF DESCRIPTION OF THE DRAWINGS

The present invention will be better understood and appreciated more fully from the following detailed description, taken in conjunction with the accompanying drawings, in which.

DETAILED DESCRIPTION OF THE EMBODIMENTS

Figure 1A:
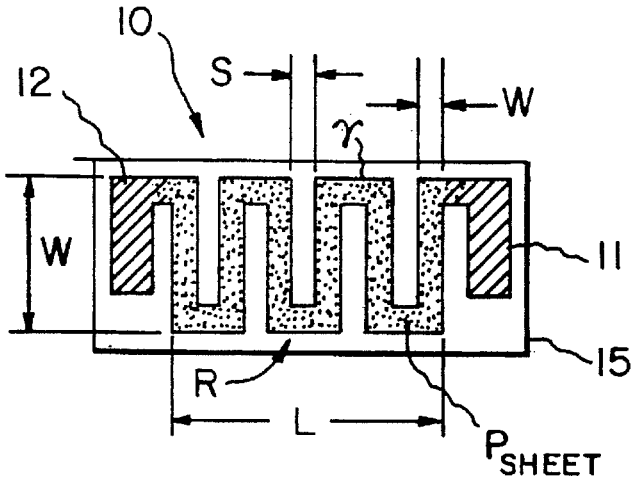
FIG. 1A is a simplified view of a serpentine line pattern thick film resistor with overall area of a substrate occupied defined by dimensions W and L, having a resistive line r of total length l, width w and a line-to-line spacing s of the serpentine line pattern. Resistance R and an aspect ratio n are defined for this serpentine line pattern resistor.

Referring now to FIG. 1A, there is shown a single planar resistor 10 on a substrate 15. The resistance R is provided by a serpentine thick film pattern of a resistive line r of total line length l, whereby the serpentine pattern is shown to have a line width w and a line spacing s, the pattern extending over a total substrate area A of length L×width W. Also shown on substrate 15 are terminations 11 and 12 connected to each of the ends of the serpentine pattern. The terminations 11, 12 may be made of conductive material different from the material forming the resistor pattern, and they may be deposited on the substrate prior to, or subsequent to, printing the fine-line thick film pattern.

In general, a slab-shaped resistive material of uniform thickness t, width w and length l has a resistance $R=\rho\times l/w\times t$, where ρ is the specific resistivity of the material, given in ohm×cm. For a resistive film of fixed or invariant thickness, the resistance can be expressed as $R=\rho_{sheet}\times l/w=\rho_{sheet}\times n$, where $\rho_{sheet}$ is the sheet resistivity of the film material, given in ohms per square (Ω/■), and n=l/w is referred to as the aspect ratio, which can be thought of as a number of unit areas connected in series to account for a particular geometrical arrangement of the resistor R.

Within a given total area A=length L×width W, the achievable resistance R of a patterned sheet or film of resistive material ($\rho_{sheet}$) depends critically upon the details of the pattern. For example, in the serpentine resistive pattern shown in FIG. 1A, a resistive line r of width w, a line-to-line spacing s and total line length l between terminations 11, 12, the resistance R of the serpentine pattern can be expressed as $$R=\rho_{sheet}\times L\times W/w(w+s) \qquad \text{Eq. (1)}$$

In the special case where the line width w and the line-to-line spacing s are equal, the resistance R is related to the geometrical factors by $$R=\rho_{sheet}\times L\times W/2w^2 \qquad \text{Eq. (2)}$$

Figure 1B:
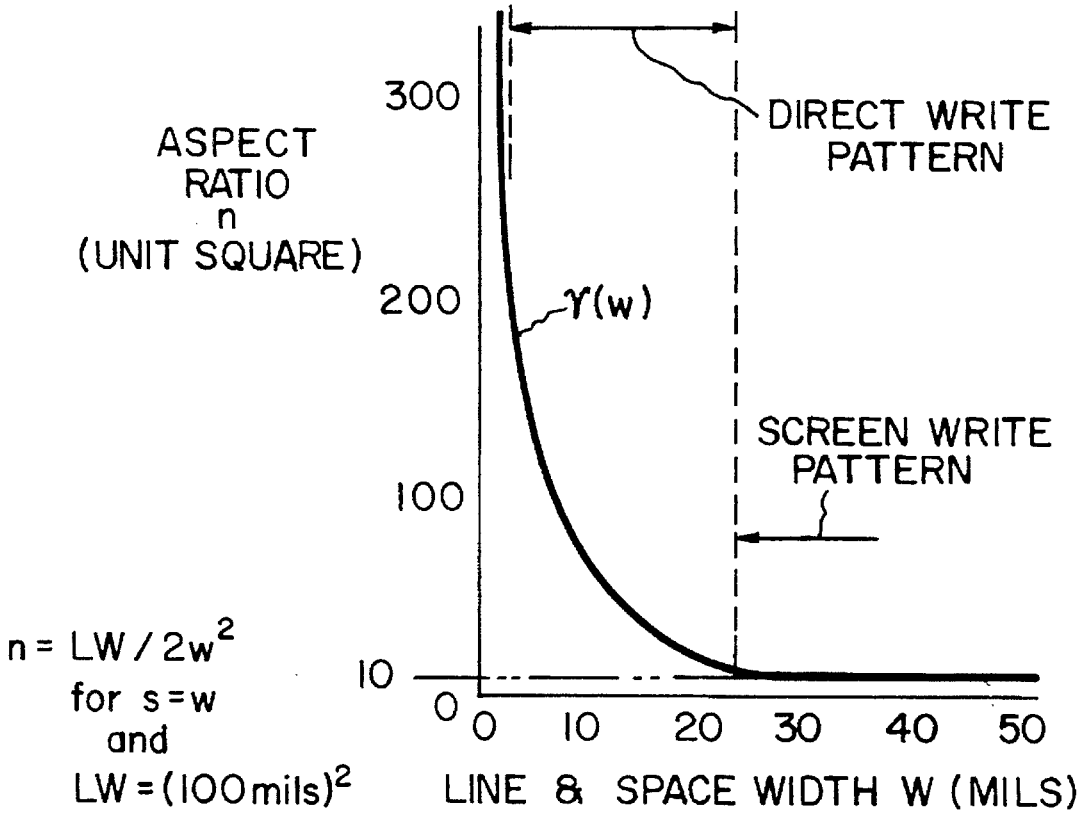
FIG. 1B indicates the relationship between the aspect ratio n and the line width w for the case where line width w equals the line-to-line spacing s, showing the particular advantage of fine-line thick films to provide higher aspect ratio values ranging from about 10 to an upper limit exceeding 300 within a selected and fixed substrate area.

Referring now to FIG. 1B, there is shown a graph relating the aspect ratio n to the line and space width w of FIG. 1A. Here, the aspect ratio is computed on the basis of a fixed area LW equal to 100 mils×100 mils ($10^4$ square mils). It is evident from FIG. 1B that the aspect ration increases rapidly as the line and space width w decrease from about 25 mils to about 4 mils. This range of high aspect ratios for the resistive lines r is particularly advantageous for directly written thick film composition lines, whereas conventional screen-printed patterns typically have a lower size limit of about 25 mils due to the nature of the screen-printing process. Thus, it is apparent that by selecting small values of line width w and of line spacing s, large resistance values can be generated from high aspect lines directly written on a substrate in a serpentine pattern, where the overall pattern dimensions L, W are comparable to overall dimensions of a conventional screen-printed thick film resistor with a thick film pattern covering an area A=L×W. Depending on design criteria, resistors and resistor networks can be fabricated such that the line-to-line spacing s is substantially smaller or larger than the width W of the resistive line r or s and w can be equal. Thus, in practical resistor or resistor network designs, the ratio w/s can range from about 0.1 to 10.

Figure 2:
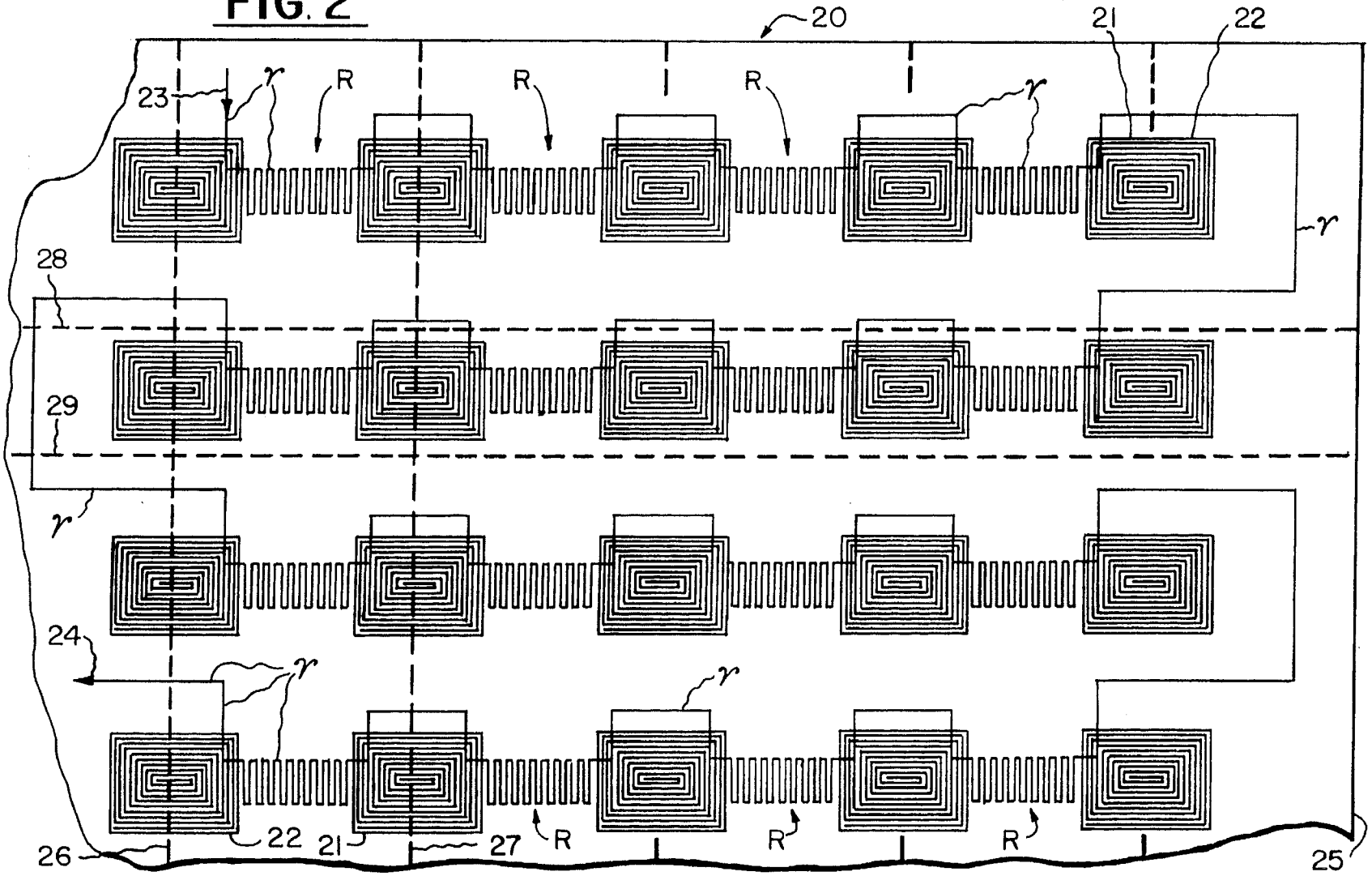
FIG. 2 illustrates a magnified section of an insulative substrate with a multiplicity of identical fine-line thick film resistors deposited thereon in accordance with one embodiment of the invention, including the locations of subsequent lines of singulation of individual resistors.

Referring now to FIG. 2, there is shown an array 20 of a multiplicity of identical fine-line thick film resistors R and associated terminations 21 and 22 on a substrate 25. Dashed lines 28, 29 and 26, 27 schematically indicate the lines along which the substrate 25 will be cut to provide individual resistor elements with one termination on each end of each fine-line thick film resistor. For that reason, terminations have been designated at 21 and 22, respectively, since the cuts are intended to extend through the center of the terminations along lines 26 and 27. Conductive,terminations 21, 22 may be deposited on substrate 25 before commencing the direct fine-line writing of the resistor pattern with resistive line r, indicated as commencing on the substrate at a location 23 and indicated as terminating at a location 24. Fine line r not only writes the serpentine resistive pattern of resistors R, but also intersects or partially traverses each one of conductive terminations 21 and 22. In this manner, a multiplicity of fine-line thick film resistors having high aspect ratio resistive lines r can be fabricated on a single insulative substrate in one procedure, using one thick film composition and one line width in the writing by the writing or inking system. Thus, fabrication of large numbers of virtually identical resistors can be greatly facilitated.

Figure 3:
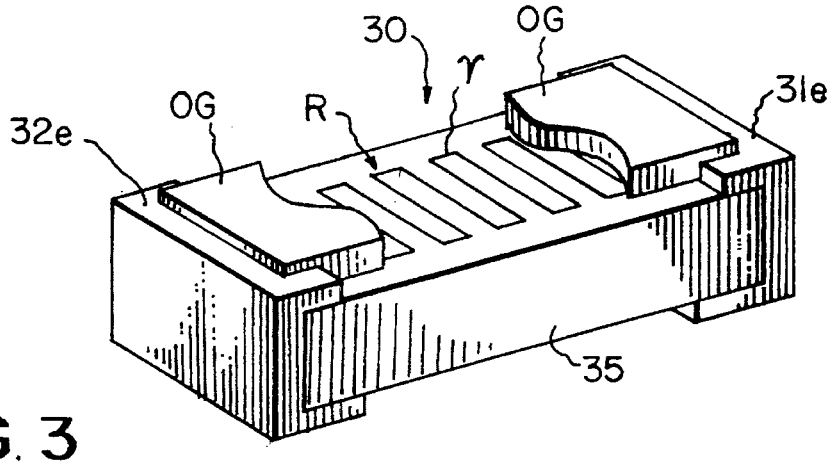
FIG. 3 is a schematic perspective view of a single finished thick film chip resistor with a fine-line serpentine resistor pattern fabricated in accordance with the invention, showing wrap-around external metalized terminations and a portion of an overglaze layer.

Referring now to FIG. 3, there is shown a schematic view of a single finished thick film chip resistor 30, having a resistance R formed by a serpentine line pattern r on the surface of an insulating substrate 35. Internal terminations (not shown) are connected to so-called wrap-around external metalized terminations 31*e* and 32*e*, respectively at each end of the resistor. For purposes of hermetic sealing, a fractional view of an overglaze OG is indicated in the figure. The overglaze may be a conventionally screen-printed insulative glass composition.

Figure 4:
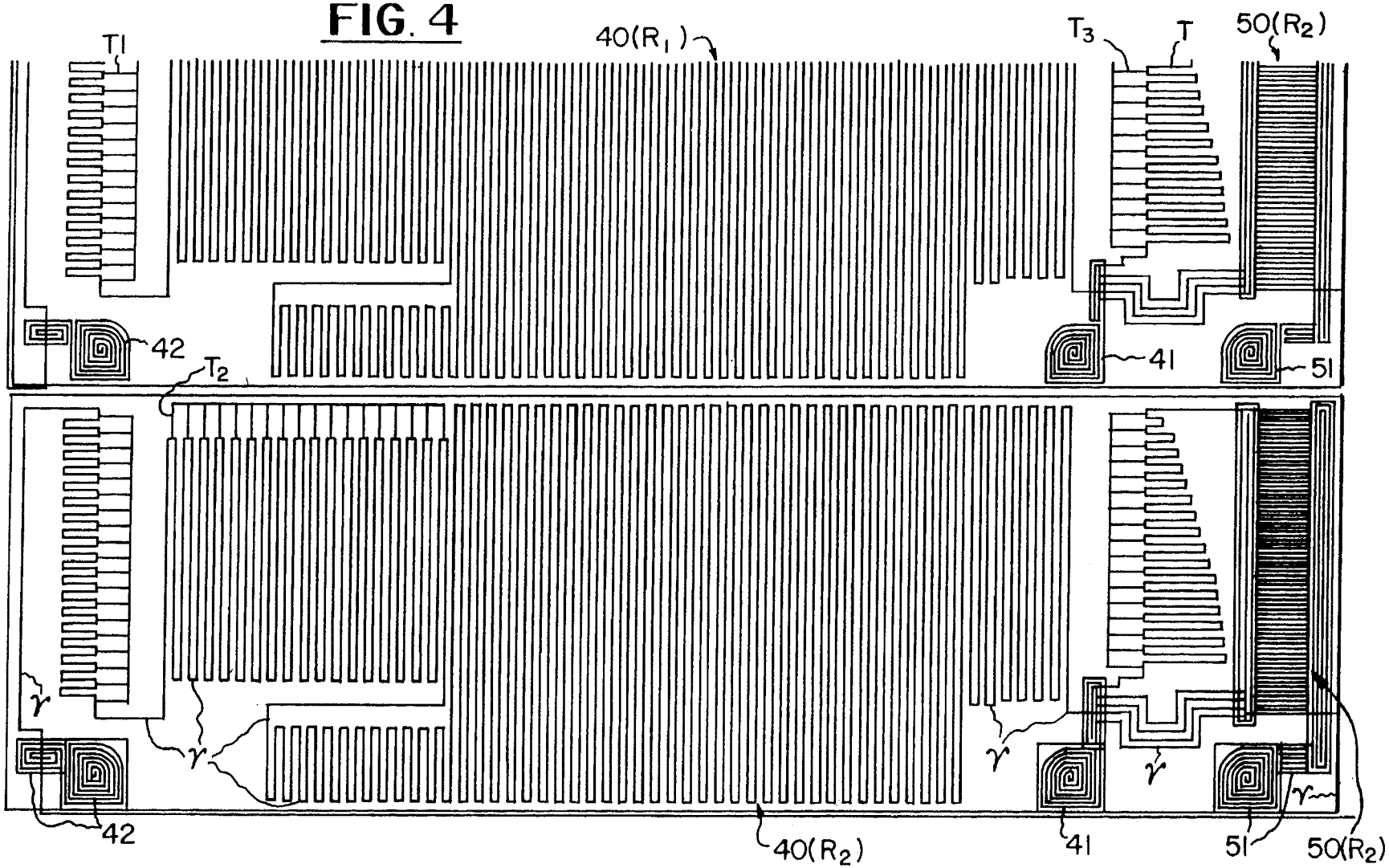
FIG. 4 shows a magnified layout of a three-terminal fine-line thick film resistor network in accordance with the invention, designed as a voltage divider network, including trimming structures for each of the two resistors of the network.

Referring now to FIG. 4, there is indicated a layout of a three-terminal fine-line thick film resistor network N 4050. The network has a first resistor 40 ($R_1$) and a second resistor 50 ($R_2$) and respective terminations 42, 41 and 51. Also shown are trimming structures $T_1$, $T_2$ and $T_3$, useful for ablatively and selectively trimming the resistors 40 and 50 to specified values. The high aspect ratio fine-line resistive pattern r is written continuously throughout the serpentine pattern of resistors 40 and 50 as well as the trimming structures, and line r intercepts each of the terminations.

While a two-resistor, three-termination fine-line thick film resistor network is shown for purposes of simplicity of the drawings, the inventor has designed and fabricated precision fine-line thick film resistor networks with five resistors and six terminations as decade voltage dividers and as custom resistive networks for high voltage applications with various external conductive terminations (spade leads; wire leads; edge clips). Prototypes of a five-resistor, six-termination resistor network were fabricated using a single conventional thick film resistive ink composition in a fine line pattern of overall dimensions LW=0.75 inch×0.15 inch on a planar insulative substrate. The line pattern (aspect ratio) of each of the five resistors $R_1$–$R_5$ was designed such that $R_1$ had an aim value of about 14 MΩ; $R_2$ was designed to be approximately $0.1\times R_1$; $R_3\approx 0.01\times R_1$; $R_4 \approx 0.001\times R_1$; and $R_5\approx 0.0001\times R_1$. Thus, a voltage divider resistive network was obtained with resistance values $R_1$–$R_5$ extending over five decades. The resistive ink composition (DuPont composition #1731) had a nominal sheet resistivity $\rho_{sheet}$=1 kΩ/■, and palladium-gold conductive ink was used for the terminations. The resistor network was fired in a conventional belt furnace at 850° C. and then overglazed.

Figures 5A, 5B, 5C:
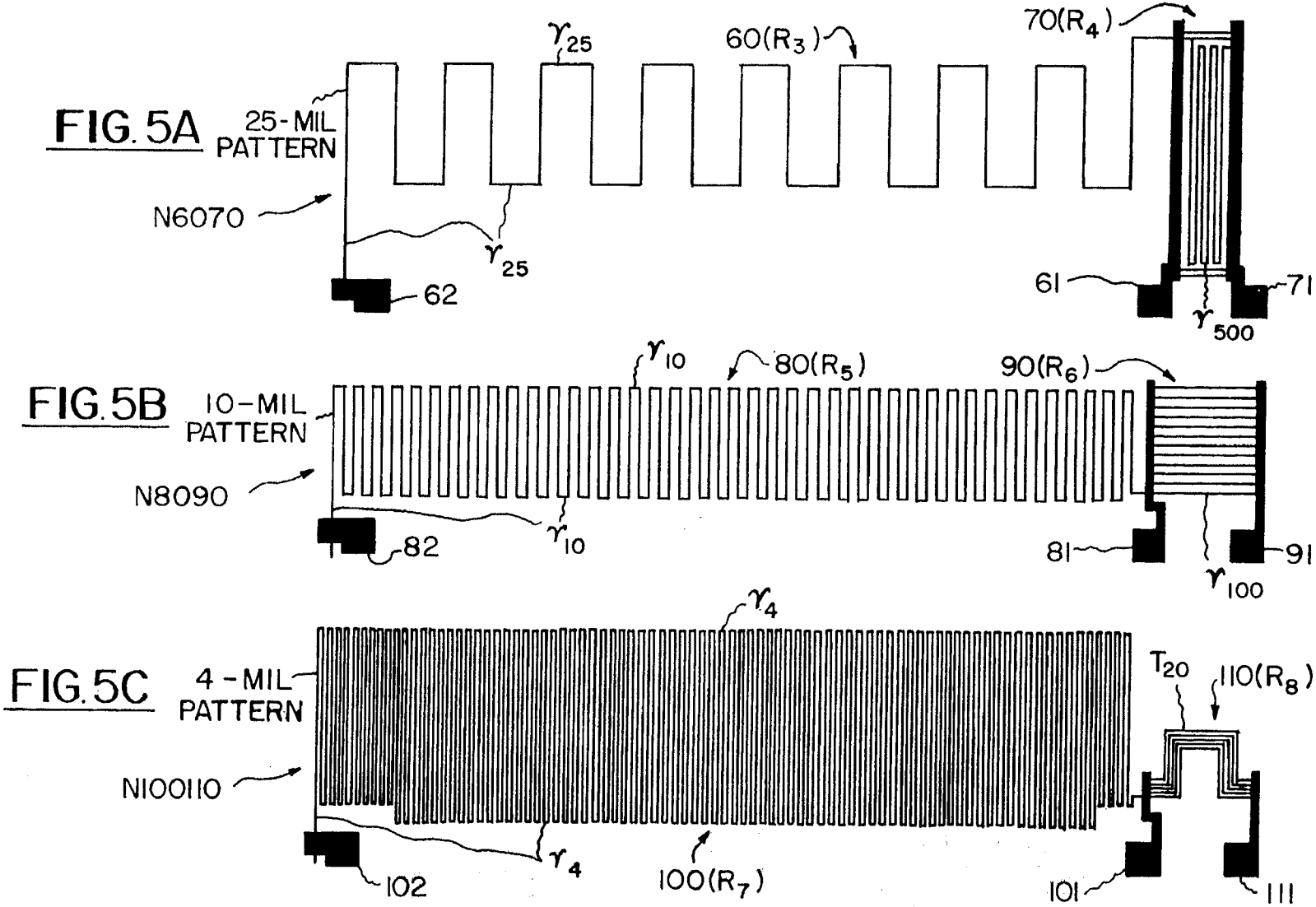
FIGS. 5A–C depict two-resistor voltage divider networks with three terminals, respectively, where each network has at least one serpentine thick film resistive trace or line r in accordance with the present invention, and each one of the networks fabricated with a fixed but different line width of the lines and with several thick film compositions of different nominal sheet resistivity.

Referring now to FIGS. 5A–5C, there are shown three fine-line thick film resistor networks, each network having at least one serpentine-shaped resistor. Each of the networks was fabricated on insulative alumina substrates by direct writing of the resistive line pattern r using commercially available ruthenium-based inks of different compositions (different sheet resistivities), whereby each pattern was written to achieve a different final effective width of the line r for the resistor segments. Both segments of each resistor network were written with one and the same line width. The effective line widths of the low resistance segments were achieved by writing a selected number of resistive lines in a parallel configuration between conductive terminal bars connected to respective conductive terminations. These respective terminations and terminal bars were of conventional conductive composition. An overglaze of a low temperature glass formulation was provided on each network.

Referring now particularly to FIG. 5A, there is shown a fine-line thick film resistor network N 6070 extending between terminations 61, 62 and 71 respectively. This network has a first resistor 60 ($R_3$) and a serpentine resistor 70 ($R_4$). The serpentine resistive lines $r_{25}$ were written to different effective nominal line width (25 mils and 500 mils, respectively) with the same composition for each resistor (see TABLE 1 for details). The effective line width of 500 mils for resistor 70 ($R_4$) was achieved by writing the 25 mil line with several parallel paths between terminal bars 61*a* and 71*a*.

Resistor network N 8090, shown in FIG. 5B, has a serpentine-shaped resistor 80 ($R_5$) and a resistor 90 ($R_6$) with associated conductive terminations 81, 82 and 91, respectively. TABLE 1 provides details about sheet resistivities of the two thick film compositions used and the nominal effective widths of resistive lines $r_{10}$, where resistor 90 ($R_6$) has an effective line width of about 100 mils (parallel resistive lines between terminal bars 81*a* and 91*a*).

FIG. 5C shows a resistor network N 100110 composed of a resistor 100 ($R_7$) and another resistor 110 ($R_8$) with associated conductive terminations 101, 102 and 111, respectively. Resistor 100 ($R_7$) of this network was written with a resistive line $r_4$, indicative of a final pattern line width of about 4 mils, and resistor 110 ($R_8$) was written with five parallel resistive lines $r_4$, between conductive terminal bars 101*a* and 111*a*, respectively. Each pattern was written with one and the same composition (see TABLE 1).

Several ruthenium-based thick film compositions were used, covering several orders of magnitude of nominal sheet resistivity of these compositions. All terminations and terminal bars were of gold alloy thick film, and all fabricated samples were overglazed. The amount of ink deposited in each case was comparable to the amount which would have produced a fired thickness ranging between 0.4 and 0.6 mils in a conventional screen-printed thick film resistor pattern.

The nominal geometrical values of the resistor networks shown in FIGS. 5A–5C and measured electrical resistance for each of the resistors of the networks are provided in TABLE 1. To simplify the presentation of TABLE 1 and subsequent tables, resistors 60 ($R_3$), 80 ($R_5$) and 100 ($R_7$) will be referred to as high segment resistors, while resistors 70 ($R_4$), 90 ($R_6$), and 110 ($R_8$) will be referred to as low segment resistors, reflective of the high and low resistance segments of the two-resistor networks, respectively.

TABLE 1

Geometrical Factors and Measured Resistance Values of High Voltage Resistive Divider Networks Fabricated with Different Sheet Resistivity of Thick Film Compositions and with Different Effective Line Widths. (Dimensions in mils)

| Resistor Segment | Effective Line Width (nominal) | Length (nominal) | Aspect Ratio (nominal) | Resistance Values at Nominal Sheet Resistivity of Composition 10M Ω/■ | 1M ω/■ | 100k Ω/■ | 10k Ω/■ |
|---|---|---|---|---|---|---|---|
| High | 25 | 6250 | 250 | 2000M Ω | 260M Ω | — | — |
| Low | 500 | 100 | 0.2 | 800k Ω | 195k Ω | — | — |
| High | 10 | 20000 | 2000 | — | 2400M Ω | 195M Ω | — |
| Low | 100 | 200 | 2 | — | 2.1M Ω | 160k Ω | — |
| High | 4 | 80000 | 20000 | — | — | 3600M Ω | 450M Ω |
| Low | 20 | 400 | 20 | — | — | 3.3M Ω | 400k Ω |

It is apparent from TABLE 1 that very high aspect ratios can be achieved for the high resistance segment resistors, and significantly lower aspect ratios can be provided for the low resistor segments by suitable geometrical design of the patterns of the low resistor segments of resistors 70, 90 and 110, as well as by selection of the number of resistive lines connected in parallel between respective conductive terminal bars 61*a*, 71*a*, and 81*a*, 91*a* and 101*a*, 111*a*. The finest resistive line pattern (nominally 4 mils line width) is capable of achieving an aspect ratio of about 20,000 in that area. The resistance values exhibit ratios of approximately 1000:1 between the high resistance segment and the low resistance segment of these voltage divider networks.

Several of the resistor networks shown in TABLE 1 and FIGS. 5A–5C were investigated to determine their operational characteristics.

Figure 6A:
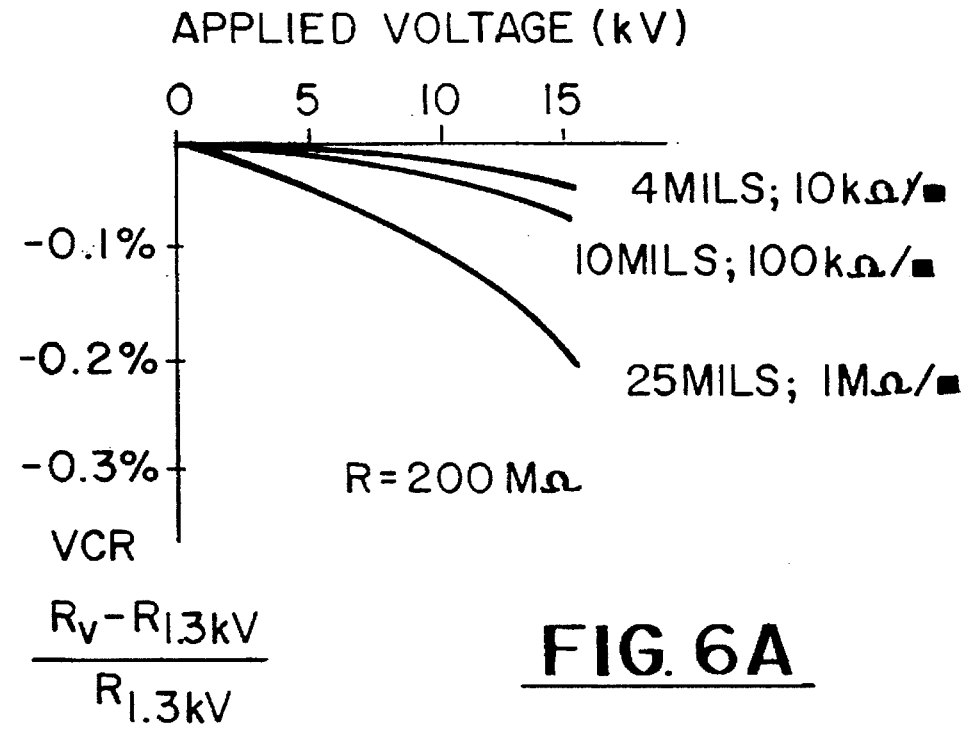
FIGS. 6A and 6B show the dependence of resistance values on applied voltage for high voltage resistance divider networks of 200 MΩ and 2000 MΩ total resistance, respectively.
Figure 6B:
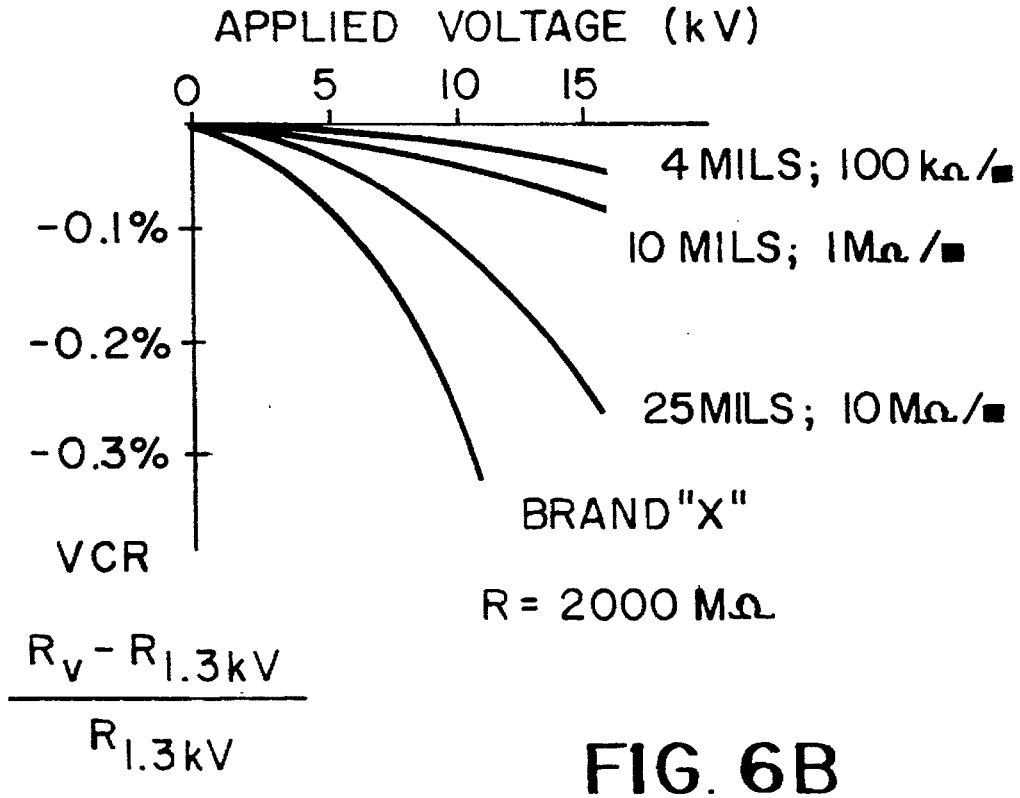

One important operational characteristic of thick film resistors, and particularly of thick film resistor networks, is the dependence of the resistance values on the voltage applied to the network. This dependence is frequently referred to as the voltage coefficient of resistance (VCR). The relationship is shown in FIGS. 6A and 6B for the samples discussed in conjunction with FIGS. 5A–5C. The determination of VCR of the resistors of the experimental directly written thick film resistor network patterns was accomplished in a modified bridge measuring arrangement wherein a precisely known voltage was applied between terminals 62 and 71, 82 and 91 and 102 and 111, respectively in FIGS. 5A–5C and that same voltage was applied to a precise standard high voltage dividing network. The voltages at terminations 61, 81 and 101 in FIGS. 5A–5C were then measured and compared to the voltages of the standard voltage divider at the same applied voltage. The variation of this ratio between the experimental divider and the standard divider with applied voltage was ascertained starting at an applied voltage of 1.3 KV, where the deviation is taken as zero From FIGS. 6A and 6B it can be seen that substantially improved voltage stability is achieved by using the patterns made from the combination of finer lines and lower sheet resistivity of thick film compositions. Also shown in FIG. 6B, for purposes of comparison, is the voltage dependence of resistance of a commercially available conventional thick film resistor network, designated as "brand X". The present fine-line low sheet resistivity networks exhibit a tracking of the voltage coefficient of resistance which is slightly less than 0.02 ppm per volt, a significant improvement of this operational characteristic over conventional thick film resistor networks.

Another operational characteristic, namely the temperature coefficient of resistance (TCR), is provided in TABLE 2 for a five-resistor, six-termination decade voltage divider network prepared from, one and the same thick film composition ($\rho_{sheet}$=1 kΩ/■), and one and the same nominal resistive line width (6 mils), but selecting resistive lines of differing aspect ratios, using (a) individual lines of different length or (b) multiple lines in parallel, all lines being of the same width. This arrangement is important to obtain desirable operating characteristics, particularly matching and tracking, when the line width is 10 mils or less.

TABLE 2

Temperature Coefficient of Resistance (TCR) of a Resistive Voltage Divider Network Fabricated with a Fixed Line Width and from a 1k Ω/■ Thick Film Composition. (TCR in ppm resistance change per °C. over the temperature range 25–75° C.)

| Resistor Designation | Aspect Ratio of Resistive Lines | Resistive Value | TCR |
|---|---|---|---|
| $R_1$ | 14,000 | 14.3M Ω | −9.6 |
| $R_2$ | 1,300 | 1.3M Ω | −8.9 |
| $R_3$ | 120 | 123k Ω | −10.1 |
| $R_4$ | 12 | 13.9k Ω | −9.6 |
| $R_5$ | 1.5 | 1.46k Ω | −9.2 |

The absolute value of the TCR, approximately 10 ppm/°C., indicates that all five resistors $R_1$–$R_5$ undergo a significant decrease in resistance as temperature increases. However, the differences among TCR values are approximately one order of magnitude smaller than the absolute values. The relative values of the resistance ratios (voltage divider ratios) are preserved to a considerable degree. Accordingly, the resistors $R_1$–$R_5$, although differing in resistance values by decades, remain very closely matched in terms of ratios ($R_1/R_2$, $R_3/R_4$, etc.) over the temperature range 25°–75° C.

To fabricate the above five-resistor network using a conventional line width of about 25 mils would have required a covered substrate area approximately 16-times larger, i.e., a significantly larger part would result.

Another operational characteristic of thick film resistors is known as current noise or current noise index. Current noise is thought to arise from the heterogeneous structure of these composite thick film materials where conductive particles are embedded in a relatively insulative, glass-like matrix. To investigate a possible relationship between current noise index (also referred to as current noise) and combinations of line width and sheet resistivity of a serpentine resistive line pattern, a series of single resistor elements was prepared and fired by using commercial ruthenium-based thick film compositions ranging over several orders of magnitude in sheet resistivity. A 6 mil orifice was installed on the line-writing equipment to produce lines of different widths (single width, triple width and 7-fold width ). Each resistor pattern occupied approximately the same overall area on an insulative substrate (160×200 mil) between terminations printed on 100 mil centers. These resistors were approximately 330, 33 and 3.3 unit squares, respectively. The 33 square pattern was made up of three touching 6 mil wide parallel resistive lines, while the 3.3 square unit pattern was made up of seven touching 6 mil lines in parallel. The 330 unit square element consisted of a single 6 mil wide serpentine resistive line.

TABLE 3 provides geometrical factors and measured resistance values for different combinations of sheet resistivity and aspect ratio of these resistors to be used for determination of current noise (or current noise index). Resistors of approximately comparable resistance value (positioned diagonally in TABLE 3) were compared on the basis of current noise index.

TABLE 3

Geometrical Factors and Measured Resistance Values of Thick Film Resistor Patterns Fabricated with Compositions of Different Sheet Resistivity Values and with Different Line Widths.

| | Total Line Width (mils) | | |
|---|---|---|---|
| | 40 (7 × 6 mil) | 18 (3 × 6 mil) | 6 |
| | Aspect Ratio (unit squares) | | |
| | 3.3 | 33 | 330 |
| Sheet Resistivity of Composition | Resistance Value | | |
| 30 Ω/■ | — | — | 9k Ω |
| 300 Ω/■ | — | 6.6k Ω | 77k Ω |
| 3k Ω/■ | 9k Ω | 73k Ω | 870k Ω |
| 30k Ω/■ | 93k Ω | 735k Ω | 9.5M Ω |
| 300k Ω/■ | 647k Ω | 6.2M Ω | — |

Figure 7:
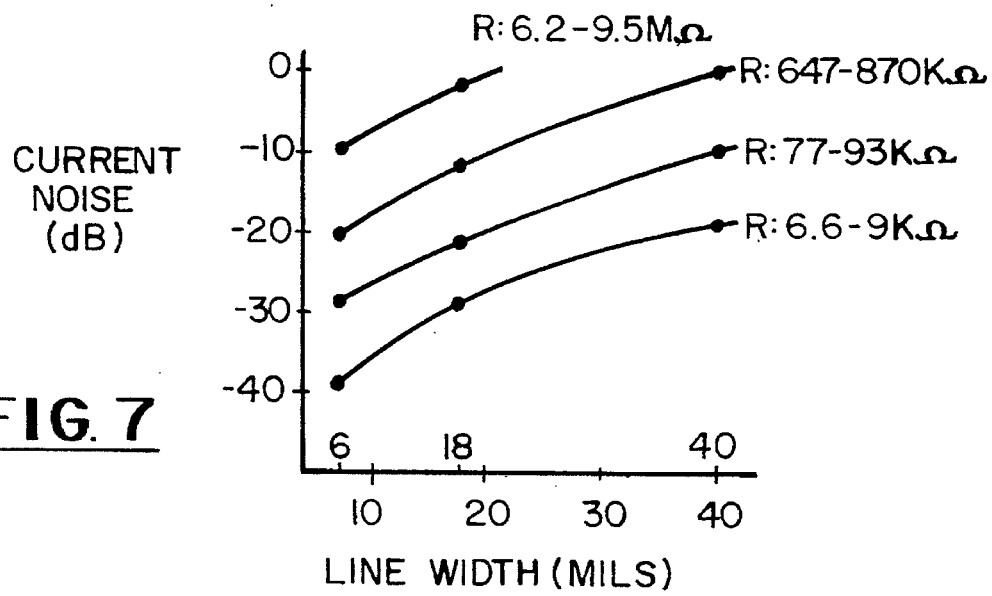
FIG. 7 shows the dependence of current noise index on line width of thick film resistors having serpentine resistive lines directly deposited from different sheet resistivity compositions.

The current noise data from TABLE 3 are shown in FIG. 7, from which it is evident that the current noise (in decibel units) decreases for each comparable resistance value with decreasing line width as the sheet resistivity of each composition decreases. Thus, from the point of view of the voltage coefficient of resistance, as well as the current noise index, it is clearly advantageous to select the finest possible orifice for direct writing of serpentine fine-line resistive patterns which will permit using the lowest sheet resistivity printing ink or composition which will, in conjunction with the geometrical features of the pattern, provide the desired resistance value.

Figure 8:
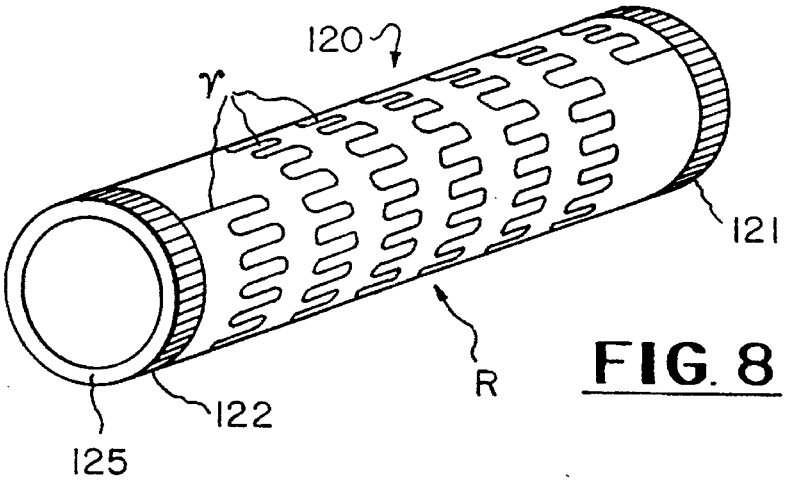
FIG. 8 is a schematic view of a fine-line thick film resistor having a resistor line as a helix disposed on a cylindrical insulative surface in accordance with the present invention.

Accordingly, the invention provides a method of fabricating fine-line thick film resistors of high resistance value suitable for high voltage applications and suitable as resistor networks for these applications. Utilizing these findings makes it possible to design and fabricate fine-line thick film resistors and resistive networks having operating characteristics not available in conventional screen-printed thick film resistors or networks. Referring now to FIG. 8, there is shown a cylindrically shaped fine-line thick film resistor 120 whose serpentine resistor pattern is a continuous directly written resistive line r disposed as a helix along the outer radial surface of the cylinder, between and onto a conductive electrode ring or termination 121 and 122 at each axial end of the cylinder. The cylindrical substrate 125 is shown as a hollow cylinder in FIG. 8, but the substrate can also be a solid cylindrical rod. It will be appreciated that a serpentine resistive pattern wound around a cylinder as a helix will provide for a resistor with very low inductance, particularly suitable for high frequency applications of very high resistance value resistors.

From the foregoing description, it will be apparent that improved fine-line thick film resistors and resistor networks have been provided by direct writing of resistive line patterns on insulative substrates. Selection of geometrical factors of the pattern in conjunction with a wide range of sheet resistivity of thick film compositions used for writing the patterns, permit fabrication of resistors and resistor networks which exhibit very high resistance values, are suitable for high voltage applications, and have advantageous operational characteristics in terms of voltage coefficient of resistance, current noise index and temperature coefficient of resistance. The capacity to vary both film sheet resistivity and aspect ratio of resistive lines over extended ranges provides several distinct advantages: With a given film and in a given physical size (area), much higher resistance values can be attained, or a greatly extended range of aspect ratios in multi-value networks can be chosen, or one and the same resistor or resistor network can be fabricated in a significantly smaller size, or a resistor or resistive network of a given size (area) can be produced to have substantially improved operational characteristics. Variations and modifications thereof within the scope of the invention will undoubtedly suggest themselves to those skilled in this art. Accordingly, the foregoing description should be taken as illustrative and not in a limiting sense.

I claim:

1. A resistor of resistance R comprising an insulative substrate, first and second designated conductive terminations on the substrate and an electrically resistive line of a heterogeneous resistive composition having a sheet resistivity $\rho_{sheet}$ directly written on the substrate in a continuous pattern extending between and onto the first and second terminations, said resistive line being of line width w and total length l and having an aspect ratio n equal to l/w exceeding a value of ten, the value of resistance R of the resistor being determined in accordance with the relationship $R=\rho_{sheet}\times n$.

2. The resistor according to claim 1 and wherein the pattern of the resistive line is a serpentine line pattern extending over a length L and width W on the substrate between the terminations, nearest portions of the resistive line within the pattern being spaced from one another by a distance s so that the value of resistance R of the resistor is determined in accordance with the relationship $R=\rho_{sheet}\times L\times W/w\ (w+s)$.

3. The resistor according to claim 2, wherein the ratio w/s of the resistive line pattern is at least 0.1.

4. The resistor according to claim 1 and wherein the resistive line is directly written by at least one continuous trace of the resistive composition deposited between and onto the first and second terminations on the substrate.

5. The resistor according to claim 1, wherein a desired value of resistance R is obtained by selection of the aspect ratio of the resistive line in conjunction with selection of the sheet resistivity of the resistive composition so as to provide said resistance value.

6. The resistor according to claim 1, wherein the substrate is a planar substrate having two major surfaces, with said first and second designated conductive terminations and said resistive line deposed on one of the major surfaces.

7. The resistor according to claim 1, wherein the substrate is a cylindrical substrate having an outer radial surface and two axial ends, said resistive line directly written in a continuous serpentine pattern and the pattern disposed as a helix along said radial surface and extending between and onto a conductive termination disposed at each of said axial ends.

8. The resistor according to claim 1, wherein said resistor has a certain current noise index value.

9. The resistor according to claim 8, wherein a desired value of resistance R is obtained by selection of the aspect ratio of the resistive line in conjunction with the selection of the sheet resistivity of the resistive composition so as to provide said resistor having said resistance value and said current noise index value.

10. The resistor according to claim 1, wherein said resistive line has a line width w narrower than about 10 mils.

11. A multiplicity of identical resistors of resistance R on an insulative substrate having a multiplicity of designated conductive terminations on the substrate, comprising an electrically resistive line of a heterogeneous resistive composition having a sheet resistivity $\rho_{sheet}$ directly written and disposed on the substrate in a continuous pattern extending between and over each one of the multiplicity of designated conductive terminations, said resistive line being of line width w and having an identical length l between each of two of said designated conductive terminations whereby a multiplicity of identical individual resistors with designated conductive terminations is singulated on said substrate.

12. The multiplicity of identical resistors according to claim 11 and wherein said resistive line between each of two designated conductive terminations has an aspect ratio n equal to l/w exceeding a value of ten, the value of resistance R of each one of the identical resistors being determined in accordance with the relationship $R=\rho_{sheet}\times n$.

13. The multiplicity of identical resistors according to claim 11, wherein each of said resistors has a certain identical current noise index value.

14. The multiplicity of identical resistors according to claim 11, wherein said resistive line has a line width w narrower than about 10 mils.

15. A resistor network comprising an insulative substrate, (N+1) designated conductive terminations on the substrate, N resistors R1 to $R_N$ formed on said substrate between each two of said (N+1) designated conductive terminations, where N is an integer, said resistors $R_1$ to $R_N$ of said network formed by a directly written resistive line disposed on said substrate of a particular line width and of a selected total length $l_1$ to $l_N$ extending in a continuous pattern between and onto each of two of said (N+1) terminations, each resistive line pattern formed of a heterogeneous resistive composition having a sheet resistivity $\rho_{sheet}$, said resistors $R_1$ to $R_N$ interconnected on said designated conductive terminations by said resistive lines extending thereonto and wherein the resistance value of each one of the interconnected resistors $R_i$ is determined by a particular aspect ratio $n_j$ equal to $l_k/w_m$ of each resistive line pattern and by a sheet resistivity $\rho_{sheet}$ of the resistive composition, in accordance with the relationship $R_i=\rho_{sheet}\times n_j$, where i, j, k and m are integers from 1 to N.

16. The resistor network according to claim 15, wherein at least one of the resistors $R_1$ to $R_N$ of the network has a serpentine pattern of a resistive line.

17. The resistor network according to claim 15, wherein a desired value of resistance is obtained for each of the resistors $R_1$ to $R_N$ by selection of the pattern of each resistive line extending between each two of said terminations in conjunction with selection of the sheet resistivity of the resistive composition which is sufficient to provide the desired resistance values.

18. The resistor network according to claim 15, wherein the substrate is a planar substrate having two major surfaces, with said (N+1) designated conductive terminations and said N resistors deposed on one of the major surfaces.

19. The resistor network according to claim 15 and wherein at least one of said network resistors has a resistive line directly written by at least two continuous parallel and contacting traces of a resistive composition deposited between two of said designated conductive terminations on the substrate.

* * * * *